US009512674B2

(12) United States Patent
Keudell

(10) Patent No.: US 9,512,674 B2
(45) Date of Patent: Dec. 6, 2016

(54) EXPANDABLE FENCE GATE FRAME ASSEMBLY

(71) Applicant: John G. Keudell, Sidney, MT (US)

(72) Inventor: John G. Keudell, Sidney, MT (US)

( * ) Notice: Subject to any disclaimer, the term of this patent is extended or adjusted under 35 U.S.C. 154(b) by 0 days.

(21) Appl. No.: 14/633,218

(22) Filed: Feb. 27, 2015

(65) Prior Publication Data

US 2016/0251897 A1 Sep. 1, 2016

(51) Int. Cl.

| | |
|---|---|
| ***E06B 11/00*** | (2006.01) |
| ***E06B 11/02*** | (2006.01) |
| ***E04H 17/14*** | (2006.01) |
| ***E04H 17/16*** | (2006.01) |
| ***E06B 11/04*** | (2006.01) |

(52) U.S. Cl.

CPC ..... *E06B 11/022* (2013.01); *E04H 17/1426* (2013.01); *E04H 17/16* (2013.01); *E06B 11/04* (2013.01)

(58) Field of Classification Search

CPC ..... E04H 17/14
USPC ..... 256/67, DIG. 2
See application file for complete search history.

(56) References Cited

U.S. PATENT DOCUMENTS

| | | | | |
|---|---|---|---|---|
| 2,245,826 A | | 6/1941 | Rowe | |
| 2,588,147 A | | 3/1952 | Morris | |
| 1,298,072 A | | 3/1979 | McNabney | |
| 4,145,031 A | | 3/1979 | Baker, II | |
| 4,793,098 A | | 12/1988 | Wilkerson | |
| 4,831,777 A | | 5/1989 | Johnson, Jr. | |
| 5,716,041 A | * | 2/1998 | Groves | E06B 11/02 256/24 |
| 5,771,505 A | | 6/1998 | Reynolds | |
| 5,868,382 A | * | 2/1999 | Groves | E06B 11/02 256/24 |
| 6,010,117 A | | 1/2000 | Doxey | |
| 6,427,396 B1 | | 8/2002 | Harrison | |
| 6,751,906 B2 | | 6/2004 | Bass | |
| 6,938,882 B2 | | 9/2005 | Hadfield | |
| D556,344 S | | 11/2007 | Robinson et al. | |
| 2002/0096673 A1 | * | 7/2002 | Siel | A01K 1/0005 256/67 |

* cited by examiner

*Primary Examiner* — Victor Macarthur

(57) ABSTRACT

An expandable fence gate frame assembly for providing an expandable frame for constructing a fence gate includes a first end assembly, a second end assembly, and an expansion assembly coupled between the first end assembly and the second end assembly such that the first end assembly and the second end assembly are positionable at a selectable distance apart with the expansion assembly extending between the first end assembly and the second end assembly. A first board connector is coupled to the first end assembly and a second board connector is coupled to the second end assembly such that the first end assembly and the second end assembly are designed to support a cross board extending between the first end assembly and the second end assembly.

14 Claims, 4 Drawing Sheets

EXPANDABLE FENCE GATE FRAME ASSEMBLY

BACKGROUND OF THE DISCLOSURE

Field of the Disclosure

The disclosure relates to fence gate frames and more particularly pertains to a new fence gate frame for providing an expandable frame for constructing a fence gate.

SUMMARY OF THE DISCLOSURE

An embodiment of the disclosure meets the needs presented above by generally comprising a first end assembly, a second end assembly, and an expansion assembly coupled between the first end assembly and the second end assembly such that the first end assembly and the second end assembly are positionable at a selectable distance apart with the expansion assembly extending between the first end assembly and the second end assembly. A first board connector is coupled to the first end assembly and a second board connector is coupled to the second end assembly such that the first end assembly and the second end assembly are designed to support a cross board extending between the first end assembly and the second end assembly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
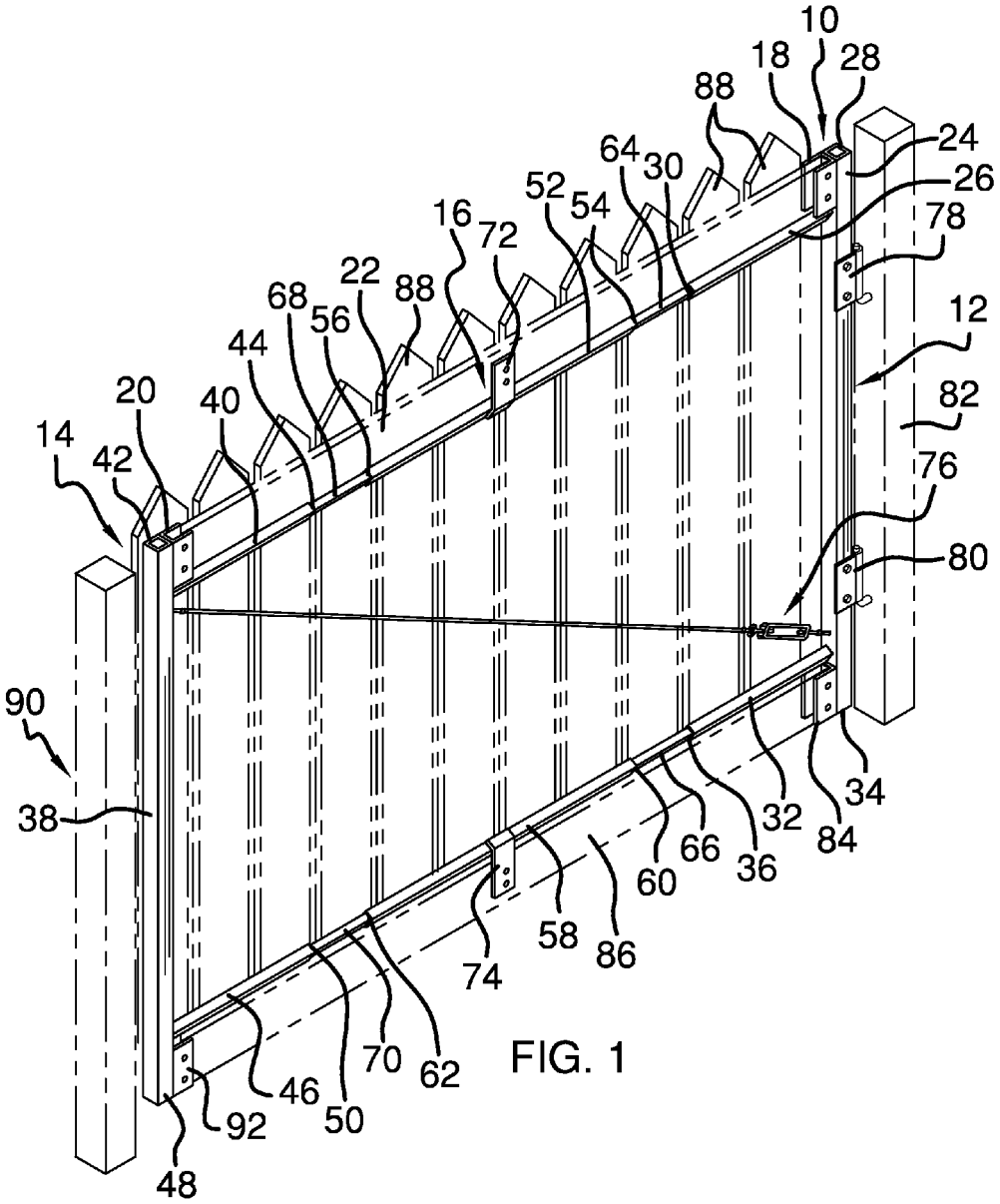
FIG. 1 is a front top end perspective view of an expandable fence gate frame assembly according to an embodiment of the disclosure.
Figure 2:
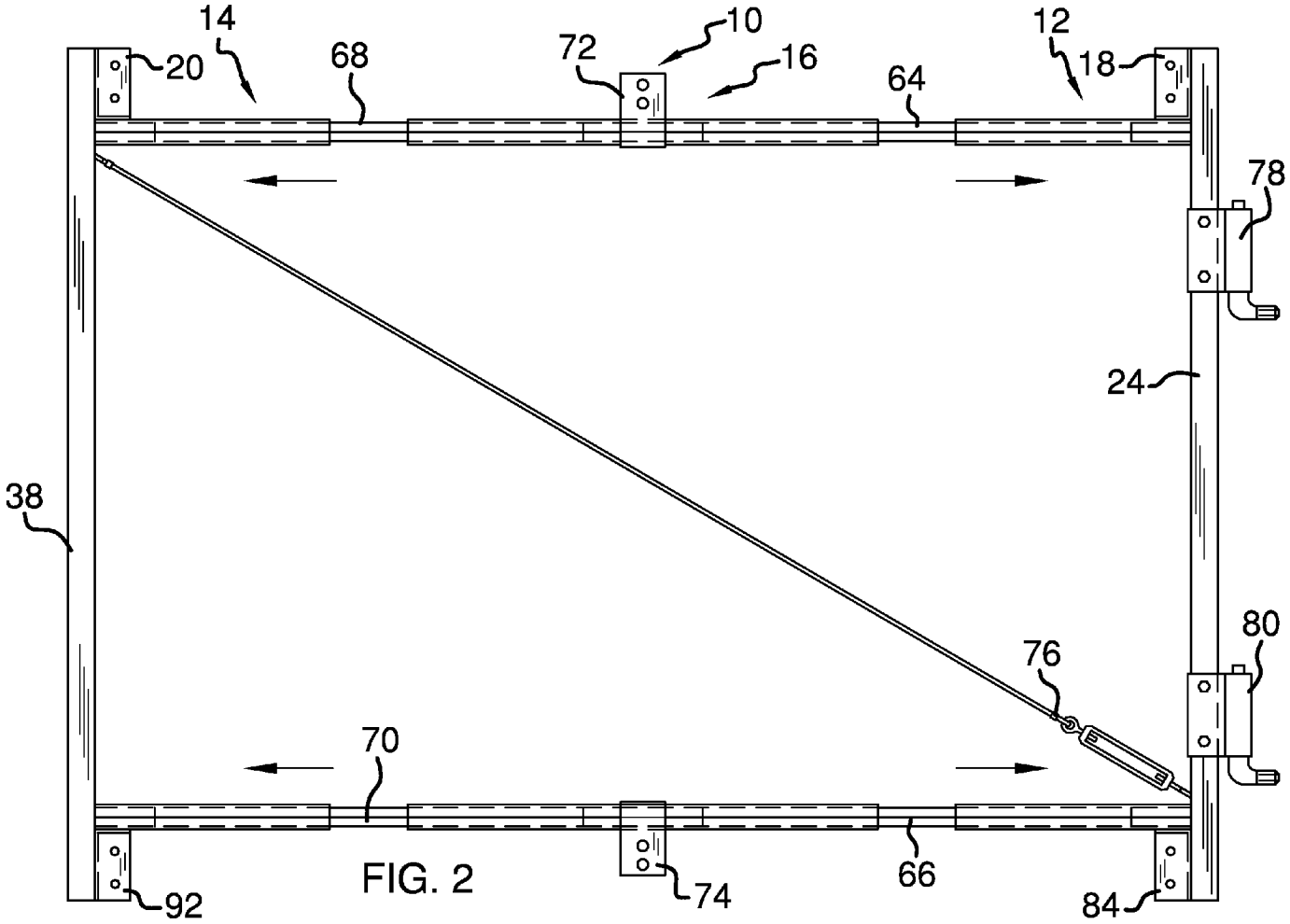
FIG. 2 is a front view of an embodiment of the disclosure.
Figure 3:
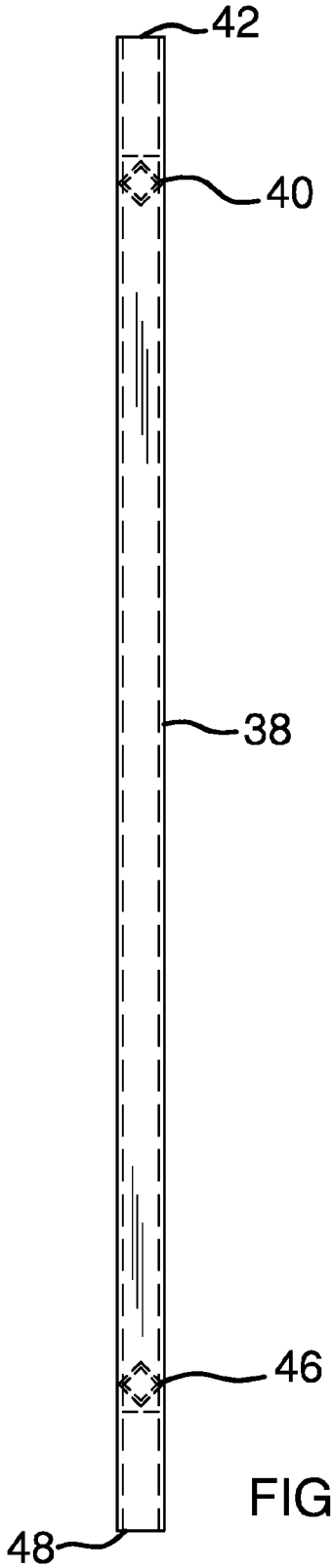
FIG. 3 is an end view of an embodiment of the disclosure.
Figure 4:
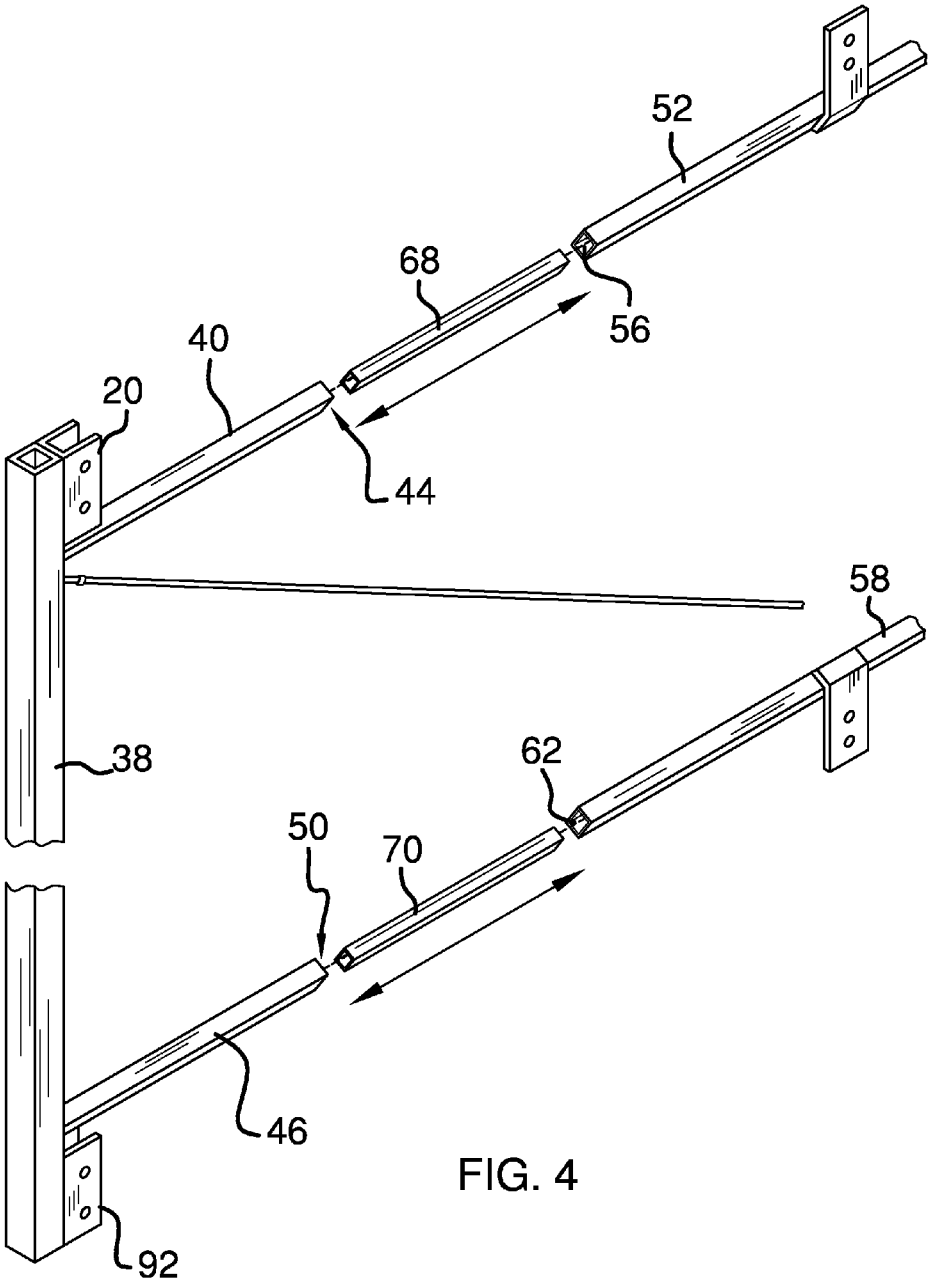
FIG. 4 is an exploded front top end view of an embodiment of the disclosure.

With reference now to the drawings, and in particular to FIGS. 1 through 4 thereof, a new fence gate frame embodying the principles and concepts of an embodiment of the disclosure and generally designated by the reference numeral 10 will be described.

As best illustrated in FIGS. 1 through 4, the expandable fence gate frame assembly 10 generally comprises a first end assembly 12, a second end assembly 14, and an expansion assembly 16 coupled between the first end assembly 12 and the second end assembly 14 such that the first end assembly 12 and the second end assembly 14 are positionable at a selectable distance apart with the expansion assembly 16 extending between the first end assembly 12 and the second end assembly 14. A first top board connector 18 is coupled to the first end assembly 12 and a second top board connector 20 is coupled to the second end assembly 14 such that the first end assembly 12 and the second end assembly 14 are designed to support a cross board 22 extending between the first end assembly 12 and the second end assembly 14.

The first end assembly 12 includes a first end member 24, a first top receiving member 26 coupled to the first end member 24 proximate a top 28 of the first end member 24. The first top receiving member 26 has an open end 30 for receiving the expansion assembly 16. A first bottom receiving member 32 is coupled to the first end member 24 proximate a bottom 34 of the first end member 24. The first bottom receiving member 32 has an open end 36 for receiving the expansion assembly 16.

The second end assembly 14 includes a second end member 38, a second top receiving member 40 coupled to the second end member 38 proximate a top 42 of the second end member 38. The second top receiving member 40 has an open end 44 for receiving the expansion assembly 16. A second bottom receiving member 46 is coupled to the second end member 38 proximate a bottom 48 of the second end member 38. The second bottom receiving member 46 has an open end 50 for receiving the expansion assembly 16.

The expansion assembly 16 has a top medial sleeve member 52 that has open ends 54,56. A bottom medial sleeve member 58 also has open ends 60,62. A first top extension member 64 is slidably inserted into and extends from the top medial sleeve member 52 for insertion into the first top receiving member 26. A first bottom extension member 66 is slidably inserted into and extends from the bottom medial sleeve member 58 for insertion into the first bottom receiving member 32. A second top extension member 68 is slidably inserted into and extends from the top medial sleeve member 52 for insertion into the second top receiving member 40. A second bottom extension member 70 is slidably inserted into and extends from the bottom medial sleeve member 58 for insertion into the second bottom receiving member 46.

A top board connection member 72 is coupled to the top medial sleeve member 52 and a bottom board connection member 74 is coupled to the bottom medial sleeve member 58. A turnbuckle assembly 76 extends between the first end member 24 of the first end assembly 14 and the second end member 38 of the second end assembly 14. A pair of hinges 78,80 are coupled to the first end member 24 of the first end assembly 12 in spaced relationship to each other. Thus, the first end assembly 12 is designed for pivotally coupling to a fence post 82.

In use, cross boards 22,86 are positioned to extend between the first end assembly 12 and the second end assembly 14. The top cross board 22 is attached directly to the first board connector 18, the second board connector 20, and the top board connection member 72. Similarly, the bottom cross board 86 is attached directly to a first bottom board connector 84, a second bottom board connector 92, and the bottom board connection member 74. Vertical slats 88 can then be attached to the cross boards 22,86 to form a fence gate 90.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An expandable fence gate frame assembly comprising:

a first end assembly;

a second end assembly;

an expansion assembly coupled between said first end assembly and said second end assembly such that said first end assembly and said second end assembly are positionable at a selectable distance apart with said expansion assembly extending between said first end assembly and said second end assembly, said expansion assembly including a top medial sleeve and a bottom medial sleeve disposed between and engaging said first and second end assemblies;

a top board connection member coupled to said top medial sleeve member, said top board connection member comprising a plate extending upwardly from said top medial sleeve member and configured to be coupled to a cross board extending between said first end assembly and said second end assembly; and a first board connector coupled to said first end assembly and a second board connector coupled to said second end assembly such that said first end assembly and said second end assembly are adapted to support the cross board.

2. The expandable fence gate frame assembly of claim 1 wherein said first end assembly comprises:

a first end member;

a first top receiving member coupled to said first end member proximate a top of said first end member, said first top receiving member having an open end for receiving said expansion assembly; and a first bottom receiving member coupled to said first end member proximate a bottom of said first end member, said first bottom receiving member having an open end for receiving said expansion assembly.

3. The expandable fence gate frame assembly of claim 2, wherein said second end assembly comprises:

a second end member;

a second top receiving member coupled to said second end member proximate a top of said second end member, said second top receiving member having an open end for receiving said expansion assembly; and a second bottom receiving member coupled to said second end member proximate a bottom of said second end member, said second bottom receiving member having an open end for receiving said expansion assembly.

4. The expandable fence gate frame assembly of claim 3, wherein said expansion assembly comprises:

said top medial sleeve member having open ends;

a bottom medial sleeve member having open ends;

said first top extension member slidably inserted into and extending from said top medial sleeve member for insertion into said first top receiving member;

a first bottom extension member slidably inserted into and extending from said bottom medial sleeve member for insertion into said first bottom receiving member;

a second top extension member slidably inserted into and extending from said top medial sleeve member for insertion into said second top receiving member; and a second bottom extension member slidably inserted into and extending from said bottom medial sleeve member for insertion into said second bottom receiving member.

5. The expandable fence gate frame assembly of claim 4, further including a bottom board connection member coupled to said bottom medial sleeve member, said bottom board connection member comprising a plate extending downwardly from said bottom medial sleeve member and configured to be coupled to a cross board extending between said first end assembly and said second end assembly.

6. The expandable fence gate frame assembly of claim 1, further including a turnbuckle assembly extending between said first end assembly and said second end assembly.

7. The expandable fence gate frame assembly of claim 1, further including a hinge coupled to said first end assembly whereby said first end assembly is adapted for pivotally coupling to a fence post.

8. The expandable fence gate frame assembly of claim 1, further including a pair of hinges coupled to said first end assembly in spaced relationship to each other whereby said first end assembly is adapted for pivotally coupling to a fence post.

9. An expandable fence gate frame assembly comprising:

a top medial sleeve member having open ends;

a bottom medial sleeve member having open ends;

a first end member;

a first top receiving member coupled to said first end member proximate a top of said first end member, said first top receiving member having an open end;

a first bottom receiving member coupled to said first end member proximate a bottom of said first end member, said first bottom receiving member having an open end;

a second end member;

a second top receiving member coupled to said second end member proximate a top of said second end member, said second top receiving member having an open end;

a second bottom receiving member coupled to said second end member proximate a bottom of said second end member, said second bottom receiving member having an open end;

a first top extension member slidably inserted into and extending between said top medial sleeve member and said first top receiving member;

a first bottom extension member slidably inserted into and extending between said bottom medial sleeve member and said first bottom receiving member;

a second top extension member slidably inserted into and extending between said top medial sleeve member and said second top receiving member;

a second bottom extension member slidably inserted into and extending between said bottom medial sleeve member and said second bottom receiving member;

a first top board connector coupled to said first end member;

a second top board connector coupled to said second end member;

a first bottom board connector coupled to said first end member;

a second bottom board connector coupled to said second end member; and a top board connection member coupled to said top medial sleeve member, said top board connection member comprising a plate extending upwardly from said top medial sleeve member and configured to be coupled to the cross board extending between said first end assembly and said second end assembly.

10. The expandable fence gate frame assembly of claim 9, further including a bottom board connection member coupled to said bottom medial sleeve member, said bottom board connection member comprising a plate extending downwardly from said bottom medial sleeve member and configured to be coupled to a cross board extending between said first end assembly and said second end assembly.

11. The expandable fence gate frame assembly of claim 9, further including a turnbuckle assembly extending between said first end member and said second end member.

12. The expandable fence gate frame assembly of claim 9, further including a hinge coupled to said first end member whereby said first end member is adapted for pivotally coupling to a fence post.

13. The expandable fence gate frame assembly of claim 9, further including a pair of hinges coupled to said first end member in spaced relationship to each other whereby said first end member is adapted for pivotally coupling to a fence post.

14. An expandable fence gate frame assembly comprising:

a top medial sleeve member having open ends;

a bottom medial sleeve member having open ends;

a first end member;

a first top receiving member coupled to said first end member proximate a top of said first end member, said first top receiving member having an open end;

a first bottom receiving member coupled to said first end member proximate a bottom of said first end member, said first bottom receiving member having an open end;

a second end member;

a second top receiving member coupled to said second end member proximate a top of said second end member, said second top receiving member having an open end;

a second bottom receiving member coupled to said second end member proximate a bottom of said second end member, said second bottom receiving member having an open end;

a first top extension member slidably inserted into and extending between said top medial sleeve member and said first top receiving member;

a first bottom extension member slidably inserted into and extending between said bottom medial sleeve member and said first bottom receiving member;

a second top extension member slidably inserted into and extending between said top medial sleeve member and said second top receiving member;

a second bottom extension member slidably inserted into and extending between said bottom medial sleeve member and said second bottom receiving member;

a first top board connector coupled to said first end member;

a second top board connector coupled to said second end member;

a first bottom board connector coupled to said first end member;

a second bottom board connector coupled to said second end member;

a top board connection member coupled to said top medial sleeve member, said top board connection member comprising a plate extending upwardly from said top medial sleeve member and configured to be coupled to the cross board extending between said first end assembly and said second end assembly;

a bottom board connection member coupled to said bottom medial sleeve member, said bottom board connection member comprising a plate extending downwardly from said bottom medial sleeve member and configured to be coupled to a cross board extending between said first end assembly and said second end assembly;

a turnbuckle assembly extending between said first end member and said second end member; and a pair of hinges coupled to said first end member in spaced relationship to each other whereby said first end member is adapted for pivotally coupling to a fence post.

* * * * *